United States Patent [19]

Fardeau et al.

[11] 4,077,322

[45] Mar. 7, 1978

[54] METHOD FOR RAPID MARKING OF ARTICLES

[75] Inventors: Michel Fardeau, Aix-les-Miles; Louis Duthion, Paris; Jean-Pierre Volat, Marseille, all of France

[73] Assignee: Hotchkiss Brandt Sogeme, Paris, France

[21] Appl. No.: 404,903

[22] Filed: Oct. 10, 1973

[30] Foreign Application Priority Data

Apr. 18, 1973 France ..... 73.14162

[51] Int. Cl.[2] ..... B41M 1/42; B41M 1/12

[52] U.S. Cl. ..... 101/129; 101/426; 197/1 R; 346/75; 346/140 R

[58] Field of Search ..... 101/114, 1, 119, 129, 101/426; 346/74, 75, 140; 117/38, 101, 104 R; 239/223, 224; 222/367, 410; 118/301; 197/1 R

[56] References Cited

U.S. PATENT DOCUMENTS

| | | | |
|---|---|---|---|
| 2,100,204 | 11/1937 | Shore | 346/75 X |
| 2,997,358 | 8/1961 | Lefebvre | 346/140 UX |
| 3,233,580 | 2/1966 | Levake | 239/223 |
| 3,281,076 | 10/1966 | Burnside et al. | 239/223 X |
| 3,443,878 | 5/1969 | Weber et al. | 101/129 |
| 3,823,409 | 7/1974 | Carrell | 346/140 |
| 3,864,691 | 2/1975 | Schroeder | 346/140 X |

*Primary Examiner*—Ronald E. Suter
*Attorney, Agent, or Firm*—A. W. Breiner

[57] ABSTRACT

A method of rapidly applying marks by spraying ink or another marking substance on to articles which move at a high speed or from a marker which is moving rapidly, comprising the step of speeding up the ink to be sprayed by centrifugal acceleration produced by rotation around an axis and guiding the ink during acceleration, so as to produce at least one ink jet along a sweeping path directed, during a fraction of a revolution, towards the article to be marked.

4 Claims, 8 Drawing Figures

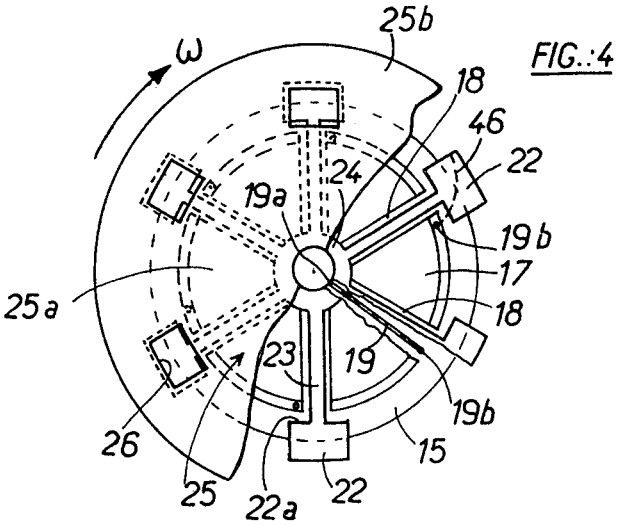
FIG.:4
FIG.:6
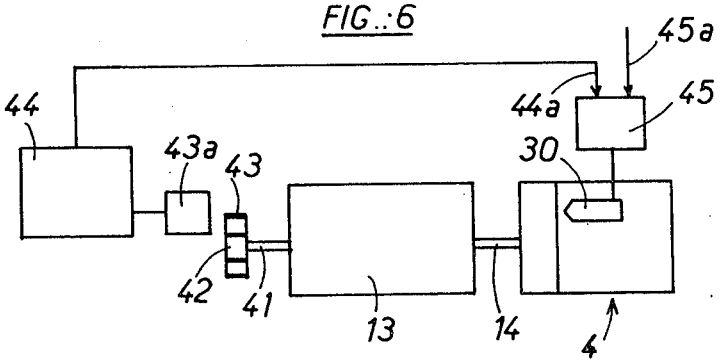
FIG.:7
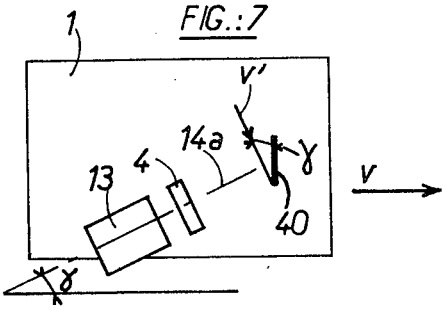
FIG.:8
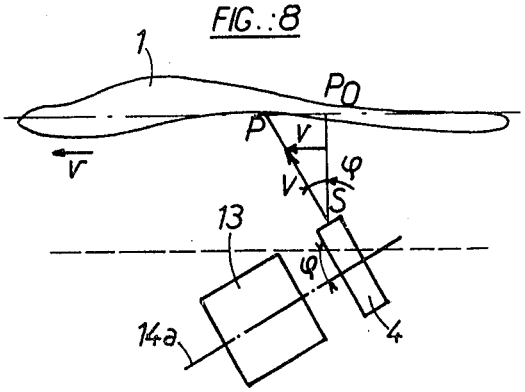

METHOD FOR RAPID MARKING OF ARTICLES

The invention, the work of Mich FARDEAU, relates to the rapid application of marks by spraying ink or another marking product on to articles which move at high speed, or from a marker which is moving rapidly.

Automatic sorting of articles or documents, more particularly postal envelopes or letters, frequently involves a preliminary indexing operation, i.e., the marking of data required for sorting, in a coded form which can easily be deciphered subsequently. The indexing may e.g. be in the form of a series of fluorescent (or phosphorescent or magnetic, etc.) bars, the position of which, with respect to a reference point, is in accordance with a code language.

Since the articles to be marked are present for only a short time, marking should be performed very quickly, in a single operation.

Marking by high-speed spraying of ink (or another marking substance) is very suitable for the aforementioned application, provided that the ink jet used is sufficiently fine.

In known systems of marking by spraying ink, a high-speed ink jet is produced usually by a nozzle having a very small diameter (of the order of a few tens of microns) supplied with ink at high pressure. As a result, there is a serious risk of choking of nozzle.

Furthermore, in known systems of the aforementioned kind, the means for regulating the jet of marking ink are frequently complicated, difficult to operate, and unsuited for industrial use.

The main object of the invention is to enable marks to be rapidly applied to articles moving at high speed, using simple, rugged means which do not have the aforementioned disadvantages and which also operate under economic conditions with regard to ink consumption.

In a method according to the invention, the ink to be sprayed is speeded up by centrifual acceleration produced by rotation around an axis. Preferably, the ink is guided during acceleration, so as to produce at least one ink jet along a sweeping path directed, during a fraction of a revolution, towards the article to be marked.

In order to prevent an article from being marked, the ink jet is turned away from its path which is directed towards the article to be marked, preferably by deflecting it from the path.

Advantageously, at least one ink jet is continuously produced. To mark an article this jet is directed toward the article, preferably when the jet moves into a predetermined reference angular position. To discontinue or avoid marking the jet is turned away from its path toward the article.

Advantageously, the ink of a jet which has been removed from its path is collected and recycled.

In its most general definition, a marking installation according to the invention comprises an ink spraying assembly comprising: a rotor rotatable around an axis, the rotor comprising at least one guide duct having an inlet orifice and an outlet orifice; motor means adapted to rotate the rotor around the axis; and means for suppying ink or another marking product to the guide duct via the inlet orifice; the outlet orifice being disposed on an outer surface of the rotor at a distance from the axis of rotation which is greater than the distance of the same axis from the inlet orifice, so that when the rotor rotates around the axis, the ink is centrifugally accelerated in the guide duct and ejected at high speed via the outlet orifice in the form of a jet along a sweeping path directed, during a fraction of a revolution of the rotor, towards the article to be marked.

Under these conditions, ink can be supplied at a very low pressure and the ink inlet and outlet orifices can have a relatively large diameter. The guide ducts need not be completely filled with ink, which considerably decreases the risk of choking or blocking the ducts. Furthermore, the ink spraying assembly is self-scouring as soon as it is rotated without being supplied with ink.

The ink spraying device according to the invention also comprises a device for turning an away from its path towards the article to be marked, so as to prevent the article from being marked; and a control device for inactivating the turning device, so as to stop the turning of the jet and enable the article to be marked. In the case where the rotor has a number of guide ducts each terminating in an outlet orifice associated with a device for turning the jet emitted by the orifice, a single control device may advantageously inactivate a number of jet-turning devices.

The jet-turning device or devices advantageously comprise a deflecting wall which can move between two positions, i.e., a deflection position in which the wall is disposed in the path of the jet, and a non-deflecting position in which the wall is out of the path of the jet.

In a preferred embodiment, the deflecting wall comprises a thin plate or paddle, for installation also comprising means for rotating the paddle around the axis of rotation in synchronism with the associated outlet orifice, the means enabling the paddle to move in a direction substantially parallel to the axis of rotation, between a position in which the jet is deflected and a position in which it is not deflected. Preferably, the aforementioned means are designed so that a slight axial movement of a deflecting paddle is sufficient to move the paddle out of the path of the associated ink jet and thus inactivate the paddle (i.e., move it into the non-deflecting position).

Advantageously, the device for controlling the inactivation of a jet-removing device comprises a device for controlling the position of the deflecting wall or paddle. The position-control device can e.g. comprise an electric control means comprising e.g. an electro-magnet actuated at the recurrence frequency at which the bars or other signs are marked on an article. Preferably, a single control means is used, i.e., is associated with all the deflecting walls or paddles, and is advantageously stationary with respect to the rotor.

Advantageously, the guide duct is inclined at least in its end outlet portion, in a direction at an angle with respect to a plane perpendicular to the axis of rotation of the rotor.

The ink spraying assembly can be constructed and inclined so as to compensate for any residual errors in positioning or centering the bars or other marks, owing to the speed of the articles being marked and/or to variations in the distance between the ink spray assembly and that surface of the article which is to be marked.

As already stated, the invention is of use not only for indexing postal envelopes or documents but also, in general, for marking information on articles.

The following exemplary non-limitative description and the accompanying drawings will clearly show how the invention can be embodied. In the drawings:

FIG. 4 is a partly cut-away plan view, along arrow IV, of the ink spraying device shown in FIG. 2;

FIG. 6 is a diagram illustrating an embodiment of a synchronization system associated with the installation shown in FIG. 1;

FIG. 7 is a diagram showing an advantageous position of the ink spraying device relative to an article which is to be marked and which moves in front of the assembly, the position being adapted to compensate, at least partly, the deforming effect due to the speed of the article, and FIG. 8 is a diagram showing an advantageous position of the ink spraying assembly relative to an article which is to be marked and which moves in front of the assembly, in order at least partly to compensate the effects of variations in the distance between the assembly and that surface of the article which is to be marked.

Figure 1:
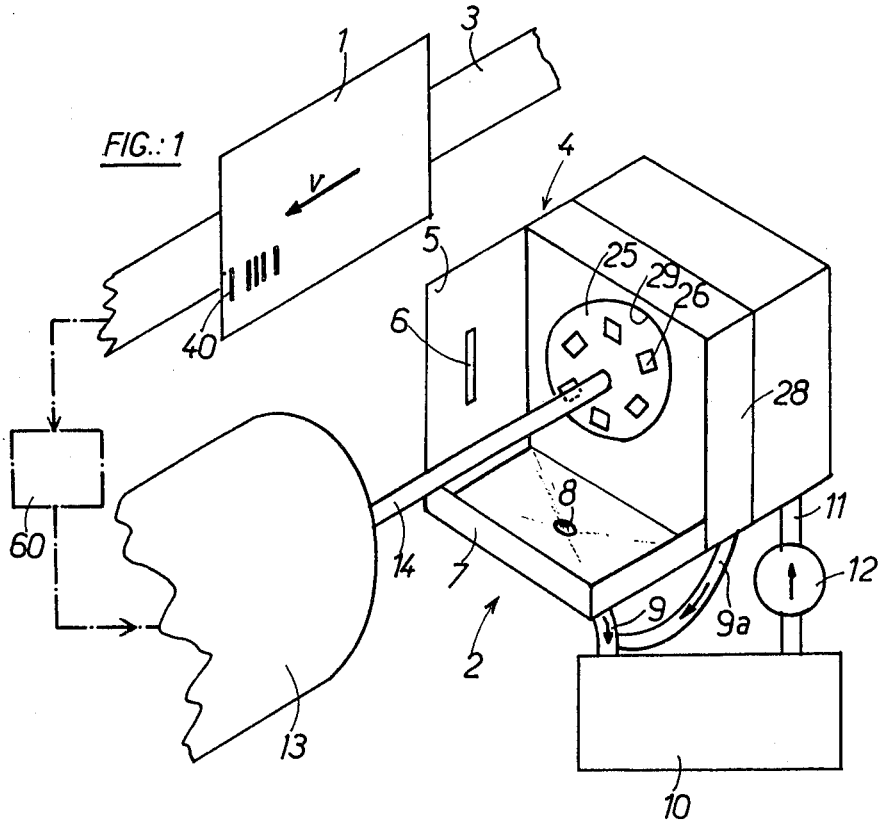
FIG. 1 is a diagrammatic perspective view of an installation for marking articles according to the invention.

The drawings, more particularly FIG. 1, show an installation 2 for rapidly marking articles 1 conveyed by a conveyor 3 at a high speed in the direction of arrow v in front of the installation. Articles 1 may e.g. be letters or other postal envelopes or documents which are to be marked with information required for subsequent automatic sorting. The information should be in coded form which can easily be deciphered subsequent, e.g. in the form of a row of fluorescent (or phosphorescent or magnetic, etc.) bars 40.

Installation 2 comprises an assembly 4 for spraying ink (or a similar marking substance) in the direction of the plane in which articles 1 move. Assembly 4 cooperates with a fixed mask 5 formed with a calibration slit 6 for calibrating the length of bars 40. A trough or pan 7 collects ink stopped by mask 5 and returns it via a discharge orifice 8 and a return duct 9 to an ink storage vessel 10. The spray device 4 is supplied with ink from the vessel 10 via a duct 11 which draws ink from vessel 10 and in which a low-pressure pump 12 is inserted. FIG. 1 also shows a motor 13 connected to the spray device 4 by a rotating shaft 14.

Figure 2:
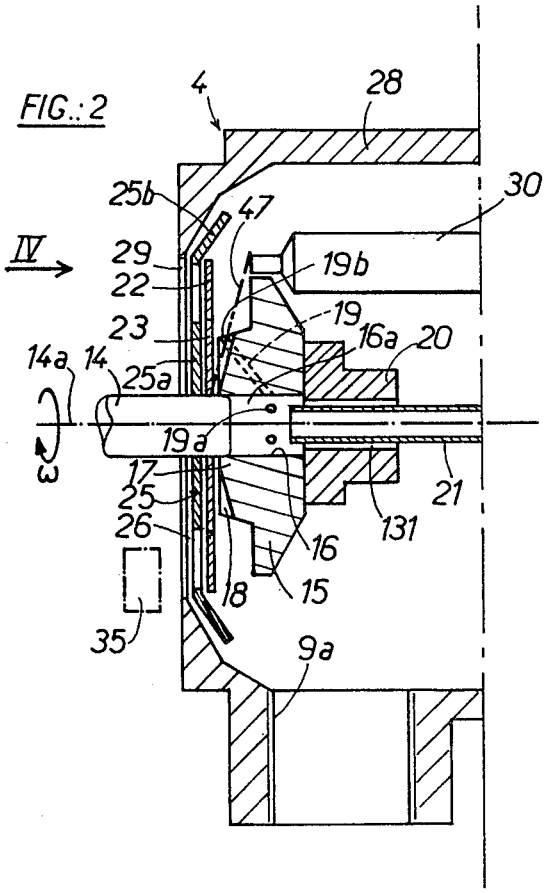
FIG. 2 is a sectional view along an axial plane through an ink spray assembly forming part of the installation shown in FIG. 1.
Figure 3:
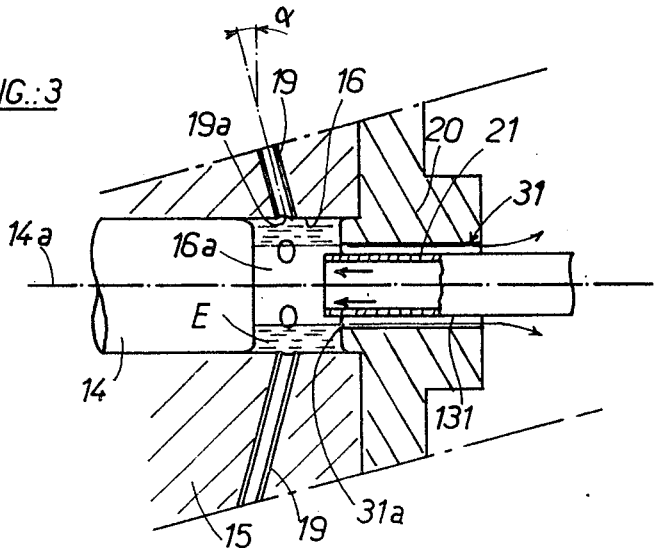
FIG. 3 is a larger-scale view of a different cross-section of a detail of FIG. 2.

The construction of the ink spraying device 4 is shown in greater detail in FIGS. 2 to 4.

In FIGS. 2–4, reference 15 denotes a disc-shaped rotor rotated at a speed $\omega$around a geometrical axis 14*a*, by shaft 14. Rotor 15 has a bore 16, coaxial with axis 14*a*, which peripherally bounds a collecting chamber 16*a* rotating with the rotor. At one end, chamber 16*a* is sealed (see FIG. 3) by shaft 14. At its other end, chamber 16*a* is partly sealed by an annular component 20 formed with a bore 31 which is coaxial with, and has a smaller diameter than, bore 16. Reference 31*a* (FIG. 3) denotes that edge of bore 31 which faces chamber 16*a*.

A stationary axial duct 21 extends through bore 31 and communicates with duct 11 shown in FIG. 1 and supplies ink to chamber 16*a*.

An annular space 131 is left between bore 31 and duct 21. The annular space constitutes a discharge duct connected to chamber 16*a* via the edge 31*a*, forming an overflow, of bore 31. If chamber 16*a* contains an excess of ink, duct 131 conveys it to vessel 10, via a discharge orifice 9*a* (FIG. 2) associated with the return duct 9.

Rotor 15 has a central projection 17 formed with screws 18 (six in the example shown in FIG. 4).

Guide ducts 19, (six in the example shown) are formed in rotor 15. Each guide duct 19 originates in an inlet orifice 19*a* in chamber 16*a* and terminates in an outlet orifice 19*b* on the outer surface of rotor 15 near screw 18. As can be seen, the distance between axis 14*a* and the outlet orifice 19*b* of a duct 19 is considerably greater than the distance between axis 14*a* and the inlet orifice 19*a* of the same duct. The outlet orifices 19*b* (six in the example shown) are distributed at regular angular intervals around the circumference of a circle coaxial with axis 14*a* and at the periphery of projection 17.

Each guide duct 19 — or at least its terminal portion near outlet orifice 19*b* — is advantageously guided in a direction at an angle $\alpha$ with respect to a plane perpendicular to the axis of rotation 14*a* (see FIG. 3).

During operation, when rotor 15 rotates around axis 14*a* and chamber 16*a* is supplied with ink, the ink admitted into guide duct 19 via orifice 19*a* is centrifugally accelerated in the duct and is ejected at high speed via outlet orifice 19*a*, in the form of a jet which, during a fraction of a revolution, travels along a sweeping path towards the article 1 to be marked.

Guide ducts 19 and orifices 19*b* are all identical, apart from their angular displacement, and can therefore emit ink jets along paths which are substantially superimposable.

The ink spraying assembly 4 comprises, in association with each orifice 19*b*, a device for turning the ink jet emitted by the corresponding orifice from its path towards the article 1 to be marked, so as to prevent the article from being marked. In the example shown, each jet-turning device comprises a jet-deflecting wall 22 which can move between two positions- i.e., a deflection position in which the wall is placed in the path of the jet, and a non-deflecting position in which the wall is moved out of the path. Each deflecting wall 22 advantageously comprises a thin, flat paddle-shaped plate, whose inner edge, facing axis 14*a*, is denoted by reference 22*a* (see FIG. 4).

Arms 23 disposed opposite screws 18 connect each paddle 22 to a central hub 24 fitted on to shaft 14 and disposed against protuberance 17 of rotor 15. Consequently, arms 23 transmit to paddles 22 the rotation imparted by shaft 14 to hub 24, so that each paddle 22 is rotated in synchronism with the associated outlet orifice 19*b*.

Arms 23 comprise thin, flexible strips which, like paddles 22, are in a plane substantially perpendicular to the axis of rotation 14*a* of rotor 15. Consequently, each paddle 22 can be moved in a direction substantially parallel to the axis of rotation towards rotor 15.

Each deflecting paddle 22 is disposed so that the associated ink jet strikes it near its inner edge 22*a* so that it is merely necessary to move the paddle very slightly in the direction of rotor 15 in order to move it out of the path of the ink jet and thus inactivate the deflecting paddle, i.e., move it into the non-deflecting position.

A cup-shaped wall 25 is disposed behind the assembly of deflecting paddles 22, relative to the direction in which the ink jets are emitted. Cup 25 is likewise fitted on to shaft 14 and thus rotated synchronously with paddles 22 and rotor 15, and has an end 25*a* which is substantially parallel to axis 14*a*, and also comprises a flange 25*b* which is curved on the side of rotor 15.

End 25a of cup 25 is formed with an orifice 26, substantially opposite end paddle 22, through which the ink jet can travel when the paddle is in the non-deflecting position. Each 25a is sufficiently near paddles 22 to act as an abutment for the paddles, as will be seen hereinafter.

The curved flange 25b of cup 25 constitutes a deflecting wall adapted to guide the ink jet after it has been deflected by a paddle 22.

The assembly comprising rotor 15, paddles 22 and cup 25 rotates inside a stationary casing 28 having a window 29. At the bottom, casing 28 has the aforementioned discharge orifice 9a. Inside casing 28 there is a control device 30 adapted to inactivate the jet-turning devices 22. In the example shown, the control device comprises an electric, e.g. electromechanical, means such as an electromagnet, which is stationary with respect to rotor 15 and is adapted to attract a deflecting paddle 22 towards rotor 15, i.e., towards the position where the paddle is not deflecting.

The ink spraying assembly 4 is disposed very near the path of the articles 1 to be marked.

The marking installation according to the invention operates as follows:

The assembly comprising rotor 15, paddles 22 and cup 25 is rotated by shaft 14, whereupon ink under low pressure is introduced into the rotating collecting chamber 16a via pump 12 and ducts 11 and 21. Under the action of centrifugal force, the ink in chamber 16a forms a liquid ring E (see FIG. 3). It then travels via orifices 19a into ducts 19, where it is guided and strongly accelerated before being ejected via orifices 19b at high speed in the form of jets driven in a direction which is inclined with respect to a plane perpendicular to the axis of rotation 14a.

Owing to the considerable centrifugal acceleration to which it is subjected in ducts 19, the ink at the outlet of the ducts occupies only a fraction of the cross-section of outlet orifices 19b. Consequently, the flow rate of ink sprayed via orifices 19b is determined at the inlet orifices 19a. Since the centrifugal acceleration at orifices 19a is low (owing to the smallness of the radius of rotation of orifices 19a and the thinness of the ring of ink E), the flow rate of ink travelling via ducts 19 can be proportioned by means of inlet orifices 19a having a relatively large cross-section. The last-mentioned orifices are easy to make and are much less liable to be choked or stopped up than conventional injection orifices. It can also be seen that the ink spray assembly 4 is self-scouring; to this end, it is merely necessary to rotate rotor 15 without supplying it with ink.

Preferably, the flow rate of pump 12 is regulated so that the thickness of the ink ring E is less than or substantially equal to the difference between the radii of bore 16 and bore 31. If the flow rate of pump 12 increases, excess ink overflows via overflow 31a in discharge duct 131 and is returned to storage vessel 10 via discharge orifice 9a.

Each jet of ink leaving orifices 19b is made up of a number of fine droplets of ink. The radius of rotation of orifices 19b and the length and cross-section of ducts 19 are selected so that the jets preserve their shape and the droplets do not disperse in the form of a mist.

When the deflecting paddles 22 are in the deflecting position, the jets leaving orifices 19b strike in corresponding paddles, which deflect them from their normal path. Consequently, they cannot travel through the orifices 26 formed in the end 25a of cup 25. The path of the ink along a paddle 22 is diagrammatically shown at 46 in FIG. 4. The curved edge 25b of cup 25 supplements and accentuates the deflection produced by paddle 22. The ink from a jet which has thus been removed from its path is collected in casing 28 and returned via orifice 9a to vessel 10 and recycled.

As can be seen, the centrifugal acceleration produced by rotation tends to keep paddles 22 and arms 23 in a position in which they are disposed in a plane perpendicular to the axis of rotation 14a. Consequently, the deflection position of paddles 22 is a stable position. The aforementioned acceleration also tends to guide any undesired ink sprays in a radial direction, i.e., different from the direction of the jets, thus substantially reducing the danger of applying undesirable marks to articles 1.

Figure 5:
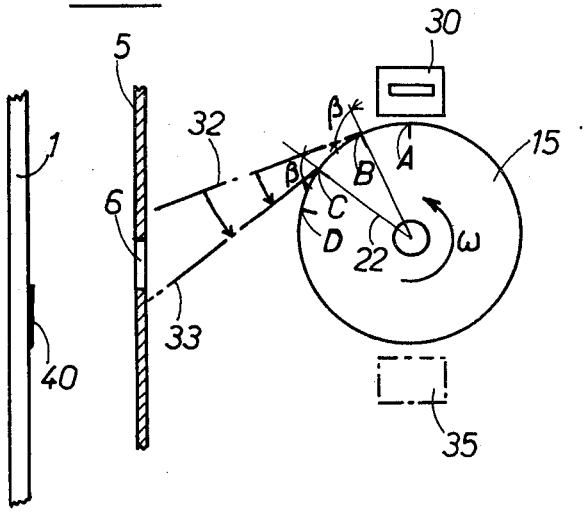
FIG. 5 is an explanatory diagram illustrating the operation of the installation shown in FIG. 1.

If a pulse is applied to electromagnet 30 at the instant when a paddle 22 moves in front of it, the paddle is attracted towards rotor 15. It then occupies its non-deflecting position (indicated in broken lines by reference 47 in FIG. 2), in which it lets the ink jet travel via orifice 26 in cup 25. Subsequently, paddle 22 returns to its normal deflecting position. It is stopped from returning by the end 25a of cup 25, which acts as an abutment when paddle 22 has reached its deflection position. The aforementioned abutment also has a slight shock-absorbing effect. If necessary, a magnet diagrammatically indicated at 35 (FIGS. 2 and 5) can be used to deaden any recoil by paddle 22. FIG. 5 shows a number of positions A, B, C, D . . . successively occupied, during the rotation of rotor 15, by an outlet orifice 19b or by the associated deflecting paddle 22. References 32 and 33 denote the respective directions in which the ink jet is emitted in portions B and C, and $\beta$ is the constant angle formed between the direction in which the jet is emitted at each point such as B and C, and the radius of rotor 15 at the point in question. FIG. 5 clearly shows that, owing to the rotation of rotor 15, the direction of emission of a jet leaving an orifice 19b considered with respect to a fixed reference mark varies continuously and cyclically. Consequently, the jet emitted by an outlet orifice 19b sweeps the space surrounding rotor 15, and the path of the jet will hereinafter be called a "sweeping path". As FIG. 5 also shows, the sweeping path is directed, during a fraction of the revolution of rotor 15, towards the article 1 to be marked.

It is important to note that orifices 19b, paddles 22 and cup-shaped member 25 are actuated relative to one another in such a manner that a large deflection of the ink jet can be stopped or restored by a slight movement of a paddle, thus producing a sort of amplification effect. Consequently, the operation can be performed very rapidly, using a simple electromechanical device (electromagnet 30), which is essential in the application under consideration, where the paddles are actuated at a very high frequency.

As FIG. 5 shows, however, there is a slight lag between the instant where the attraction pulse is sent by electromagnet 30 to paddle 22 (paddle 22 in position A) and the instant when the paddle reaches the non-deflection position (position B) and allows the jet to pass sufficiently. Similarly, there is a slight lag between the instant when the paddle returns to the normal position (i.e., in the deflection position) in which it does not allow the jet to pass sufficiently (position C), and the instant when it arrives opposite member 25 (position D). Between positions B and C the jet travels correctly and its path sweeps the space between lines 32 and 33. Consequently, the position of electromagnet 30 and of calibration slit 6 are determined with respect to one another so that slit 6 is reliably situated inside the aforementioned space.

Electromagnet 30 (and, in a more general manner, the device for controlling the inactivation of a jet-turning device) should be actuable, if an order has been received, at the instant when a paddle 22 (or other jet-deflecting device) has moved in front of magnet 30. Advantageously, therefore, the actuation of the electromagnet (or other control device) is synchronized with the angular position of the paddle 22 (or other jet-stopping device).

Synchronization can be obtained in a simple manner, as shown diagrammatrically in FIG. 6. As FIG. 6 shows, motor 13 drives a second shaft 41 bearing a wheel 42 bearing reference marks 43, e.g. magnetic marks, distributed in the same manner as outlet orifices 19*b* and paddles 22. The marks move in front of a detector 43*a* whose pulses, after being shaped at 44, constitute a synchronization signal 44*a* which is conveyed to a control unit 45 for electromagnet 30. An order 45*a* sent to unit 45 will not actuate the electromagnet unless permitted by the synchronization signal 44*a*, i.e., unless a paddle 22 is in a suitable position.

Each successive bar 40 on an article 1 is marked by a jet of ink emitted from a different orifice 19*b*, the spacing between bars being dependent on the angular spacing between two successive orifices 19*b*. It can be seen that, if a number of paddles 22 are used in association with a number of outlet orifices 19*b*, the performance of the installation can be increased while still using simple mechanical deflecting means such as paddles 22. The number of orifices 19*b* is selected in dependence on the speed at which articles 1 are driven, the speed of rotation of motor 13 and the selective spacing between the bars or other marks 40.

As FIG. 5 shows, not all the points of a bar 40 are marked on article 1 at the same instant.

Since article 1 moves at a speed $v$, there is a risk that bars 40 may not be quite perpendicular to the bottom edge of the article. Actually, the sweeping speed of bars 40 (i.e., the length of a line marked during unit time) is much greater than the speed of articles 1, so that the last-mentioned effect is usually negligible.

If necessary, however, the aforementioned disadvantage can be obviated as shown in FIG. 7 by slightly inclining the axis of rotation 14*a* of rotor 15 with respect to the direction $v$ of the articles, the inclination being through an angle $\gamma$ in a plane substantially parallel to that surface of articles 1 which is to be marked. The angle $\gamma$ depends on the ratio between the sweeping speed $v'$ of bars 40 and the speed $v$ of articles 1.

FIG. 8 shows another embodiment of the invention for ensuring that the spacing between the bars or other marks 40 is regular and substantially independent of variations in the distance between that surface of article 1 which is to be marked and the ink spraying assembly 4. Such variations in distance can be due, e.g., to variations in the thickness of article 1 (a letter) or in a displacement of the conveyor 3.

In FIG. 8 $V$ denotes the speed of the ink jet emitted at a point S from the ink spraying assembly 4, and $v$ denotes the speed of articles 1.

According to the invention, the ink jet is sprayed in a direction which, with respect to the plane perpendicular to the direction of articles 1, is inclined through an angle $\phi$ such that $\sin \phi = (v/V)$.

The appropriate angle $\phi$ can be obtained, either by acting only on the inclination $\alpha$ (see FIG. 3) of ducts 19, or only (see FIG. 8) on the inclination of the axis 14*a* of rotor 15 (which then ceases to be parallel to the plane containing that surface of article 1 which is to be marked), or by acting on both factors.

Accordingly, if we take a point $P$ on article 1 reached at instant $t$ by the jet emitted at $S$ at the instant $t = 0$, we can write $SP = Vt$.

If we now consider the right-angled triangle $SPP_o$, wherein $PP_o$ is parallel to the direction of motion of article 1 and $SP_o$ is perpendicular to $PP_o$, we can write:

$$PP_o = SP \sin \phi$$

therefore $$PP_o = Vt \sin \phi$$

Now $V \sin \phi = v$, therefore $PP_o = vt$.

Consequently, at the instant $t = 0$, point $P$ was at the point $P_o$ opposite point $S$, irrespective of the distance between point $S$ and that surface of article 1 which is to be marked In other words, variations in the time during which ink is transferred from assembly 4 to article 1, due to the movement of article 1 away from or towards assembly 4, do not modify the exact positioning of a bar 40 on article 1, and consequently do not modify the spacing between two successive bars.

According to another feature of the invention, the speed of rotation of rotor 15 can be regulated in dependence on the speed of articles 1. To this end, use can be made e.g. of a synchronous electric motor 13 supplied by an alternator 60 mechanically coupled to the conveyor 3. In this manner, the marking installation 2 automatically follows variations in the speed of articles 1, inter alia during the starting and stopping of conveyor 3.

Of course, the marking installation according to the invention can be controlled by any conventional detection and control system (not shown) which, in response to a detection signal from the edge of the letter or article 1 reaching the marking area, delivers appropriate orders 45*a* to the control unit 45 shown in FIG. 6.

By way of non-limitative example, we add some characteristic values illustrating the performance of a marking installation which gave satisfactory results in indexing letters 1 by marking the letters with fluorescent bars 40:

| | |
|---|---|
| Speed of letters 1: | v ≃4 m/s |
| Speed of rotation of rotor 15: | ≃24000 r.p.m. |
| Marking frequency, using six guide channels 19 | 2400 bars per second |
| Speed of ink | V ≃30 m/s |
| Diameter of orifices 19a and 19b | 0.3 to 0.4 mm |
| Spacing between bars 40 | ≃1.6 mm |
| Sweeping speed of bars 40 | v' ≃ 60 m/s |

In the embodiment which has been described, channels 19 are ink jets emitted by the ducts are successively conveyed, each along the same path, to the article 1 to be marked. Alternatively, in some cases, the ducts used may operate "in parallel" in time, in which case a number of ink jets are simultaneously conveyed along substantially parallel paths to the article 1 to be marked.

Of course, the embodiments described are examples only and may be modified, inter alia by substituting technical equivalents, without departing from the scope of the invention.

We claim:

1. The method of rapidly applying discrete marks to articles which are moving with respect to the marking substance comprising the steps of (1) moving articles to be marked in a predetermined path; (2) accelerating by centrifugal acceleration a marking substance by rotation around an axis of a chamber containing said marking substance; (3) guiding said marking substance during said acceleration so as to produce at least one jet of marking substance along a sweeping path; (4) ejecting said marking substance through guide orifices during a fraction of a revolution of said rotation toward said path of moving articles; (5) applying said jet of marking substance to said moving articles as discrete marks; and (6) deflecting said jet from said path to interrupt the marking of said article.

2. The method according to claim 42 including the steps of collecting and recycling the marking substance which has been deflected from its path.

3. The method of rapidly applying discrete marks to articles which are moving with respect to the marking substances comprising the steps of (1) moving articles to be marked in a predetermined path; (2) accelerating by centrifugal acceleration a marking substance by rotation around an axis of a chamber containing said marking substance; (3) guiding said marking substance during said acceleration so as to continuously produce at least one jet of marking substance along a sweeping path; (4) ejecting said marking substance through guide orifices during a fraction of a revolution of said rotation toward said path of moving articles; (5) applying said jet of marking substance to said moving articles as discrete marks; and (6) deflecting said jet other than at the interval timed to mark said article.

4. The method according to claim 3 wherein said interval for marking is timed with the jet reaching a predetermined reference angular position.

* * * * *

UNITED STATES PATENT OFFICE

CERTIFICATE OF CORRECTION

Patent No. 4,077,322 Dated March 7, 1978

Inventor(s) Michel FARDEAU ET AL

It is certified that error appears in the above-identified patent and that said Letters Patent are hereby corrected as shown below:

Column 1, line 4, after "invention," delete -- the work of Mich FARDEAU --;

Column 1, line 28, "choking of " should read -- choking the --;

Column 8, line 61, after "19 are" insert -- adapted to operate "in series" in time. In other words, the --;

Column 10, claim 2, line 1, "claim 42" should read -- claim 1 --;

Column 10, claim 3, line 15, after "articles;" insert -- and --; and

Column 10, claim 3, line 17, delete "; and (6)" and insert -- which includes --.

Signed and Sealed this

Sixteenth Day of September 1980

[SEAL]

Attest:

SIDNEY A. DIAMOND

Attesting Officer

Commissioner of Patents and Trademarks